United States Patent [19]

Sikora

[11] 4,086,472

[45] Apr. 25, 1978

[54] APPARATUS FOR CONTROLLING THE LAYING OF STRIP MATERIAL

[75] Inventor: Harald Sikora, Bremen, Germany

[73] Assignee: Harald Sikora Sikora Industrieelektronik, Bremen, Germany

[21] Appl. No.: 691,584

[22] Filed: Jun. 1, 1976

[30] Foreign Application Priority Data

Jun. 3, 1975 Germany ..... 2524411

[51] Int. Cl.[2] ..... G06M 3/02; B65H 57/28

[52] U.S. Cl. ..... 235/92 DN; 235/92 PE; 235/92 CT; 235/92 R; 242/158 R

[58] Field of Search ..... 235/92 DN, 92 MP, 92 CT, 235/92 PE, 92 MS; 242/158 R, 76

[56] References Cited

U.S. PATENT DOCUMENTS

| | | | |
|---|---|---|---|
| 3,433,434 | 3/1969 | Latter | 242/158 R |
| 3,822,831 | 7/1974 | Marcum | 242/158 R |
| 3,853,278 | 12/1974 | Berecz | 242/158 R |

*Primary Examiner*—Joseph M. Thesz

*Attorney, Agent, or Firm*—Andrus, Sceales, Starke & Sawall

[57] ABSTRACT

Apparatus for controlling the laying of strip material such as cables, ropes, hoses or the like, when winding on a drum having a guide for the strip material, the drum and the guide being relatively moveable to each other by means of a spooling drive, and having a drum drive for rotating the drum, wherein the drum or a corresponding component rotating with the drum is provided with a first marker, a first signal transmitter effects a switch-in control signal for the spooling drive with each revolution, part revolution or multiplicity of revolutions of the marker, a plurality of second markers are provided on a shaft of the spooling drive or on a component rotating with it, a second signal transmitter emits a count signal to a counting device with each of the second markers and the counting device is arranged to actuate a switch-off control signal for the spooling drive when a programmed value is attained.

12 Claims, 3 Drawing Figures

10
14
15
M
60
CORRECTION CKT.
40
70
42
TRIGGER CIRCUIT
43
3~
41
UP-DOWN COUNTER
44
45
73
71
46
47
20
72
M 3~
52
48
21
61
53
54
49
COUNTER
50
PRESET
51
COUNTER
74
55
56
57
58
59

APPARATUS FOR CONTROLLING THE LAYING OF STRIP MATERIAL

FIELD OF THE INVENTION

This invention relates to a device for controlling the laying of strip material such as cables, ropes, hose or such like, whilst winding onto a drum, with a guide for the strip material, whereby the drum and guide can be moved in relation to each other by the aid of a spooling drive, and with a drum drive for the purpose of turning the drum.

BACKGROUND OF THE INVENTION

Normally strip materials such as cables, ropes, hose etc. are so directed, when winding on a drum stripper or similar device, that an optimum number of turns can be taken on. For this it is necessary that one turn be laid exactly alongside the other. In this connection the use of a so-called laying fork is recognised which is arranged to run back and forth parallel to the axis of the winding drum in order to locate the individual turns on the drum in a predetermined manner. The coupling of the adjustment of the laying fork with a direct current drive for the drum is also recognised. It has, however, become evident that the laying accuracy with the known equipment has left room for improvement. Furthermore such equipment has been distinguished by a relatively high cost.

SUMMARY OF THE INVENTION

The invention is therefore based on the task of creating a device for controlling the laying of strip material whilst winding on a drum or similar object, which presents a maximum degree of laying accuracy and requires a minimum degree of material and installation expense, as well as cost of maintenance.

With a device of the type mentioned above this task is solved in that the drum, or a correspondingly turning component of it, exhibits an initial marker that an initial signal transmitter passes a tripping control signal to the spooling drive with each revolution of the marker, that on a shaft of the spooling drive, or on a component revolving with it, several secondary markers are provided, that a second signal transmitter passes a count signal on each second marker to a programme counter device, and that that counter passes a switchoff control signal to the spooling drive, when the number of count impulses equals a pre-set number in the counter.

With the device according to the invention, the control of the laying is achieved by the exact predicting of the path which the guide, for example a laying fork, has to traverse after one revolution of the drum, so that the next turn comes to lie exactly against the preceding one. To this purpose a control signal is generated with each turn of the drum which indicates an interpolation command to the spooling drive to initiate relative movement between drum and guide, the extent of which corresponds to the width of laying. Generally the drum is placed stationary in the axial direction so that the guide and/or laying fork can be adjusted parallel to the drum axis. The drive to the guide is effected, for example, through an adjustable spindle, which is driven by a motor. Basically, however, the reverse arrangement is possible in such a manner, that the guide is held stationary whilst the drum is mounted to be moveable in the direction of the axis, in order to effect the laying.

With the device according to the invention, the individual operations involved in the laying are programmed in a programme counter device, whereby a definite extent of winding corresponds to a programmed number of signals. The second signal transmitter measures, by counting the number of markers, the extent progressed at a relative movement between drum and guide. As soon as this extent i.e. the number of corresponding extent signals has attained the programmed number, the spooling drive is switched off. For the purpose of accepting a further turn, the drum makes a revolution, whereupon a laying operation is initiated in the manner described above.

With the device according to the invention, the laying width can be exactly programmed and with it a maximum degree of laying accuracy offered. Furthermore the device according to the invention, makes possible automatic winding, so that the service costs for a winder are considerably reduced.

For signal transmitters suitable devices can be employed which react to corresponding markers. In this connection an embodiment of the invention provides that the first and second signal transmitters are magnetically or capacitance operated proximity switches which emit an impulse, or the multiple of an impulse, for each marker. A metal lug, for example, can be used as a marker, which is connected to a motor shaft. Separated discs can however, also be used which sit directly on the motor shaft, or are driven by it through a transmission, and which are furnished with corresponding markers. Another possibility consists of a toothed wheel, which is fitted with a magnetic transmitter, which emits an impulse for each tooth of the cog. The generation of individual impulses has the advantage of simple subsequent treatment, so that a switch arrangement which is free from wear, and absolutely maintenance free, is possible with the device according to the invention.

A further embodiment of the invention provides that the spooling drive consists of a three phase motor, preferably with a squirrel cage rotor, and is switched by the first signal transmitter by means of a triac relay. The employment of a three phase motor with a squirrel cage rotor makes a further reduction in cost possible for the device in accordance with the invention, whose remaining costs are practically independent of the performance of the spooling motor. The employment of a triac relay makes possible the contact free switching of the three phase motor, so that switch wear through the formation of sparks, or corrosion, does not occur.

The theoretical number of count signals which are required for the accomplishment of a stage in the laying operation, is programmed into the programme counter device. Generally it has to be taken into account that because of the not inconsiderable moments of inertia, the spooling drive, and with it the guide, does not come immediately to a stop when it is switched off by the programme counter device. It would of course be conceivable to limit the undesired over-run by the provision of a clutch or a brake. Such provision would, however, represent an unacceptable high expense. For this reason a further embodiment of the invention provides that the counting device is automatically returned to zero, and is ready for counting once more, on attainment of the programmed number of count signals. In this manner, on over-run, count signals are generated which are stored in the counting device, so that the count signals to be subsequently generated by the spooling drive, need to be fewer in number in order to again reach the programmed number of count signals. In this manner the over-run of the spooling drive is compensated, irrespective of its extent.

Although the device according to the invention, guarantees an accurate laying, it is practical for purposes of correction to provide a run-over arrangement by which the spooling drive can be controlled independent of the first signal transmitter, in order to effect possible corrections.

As soon as the drum has taken up its winding position, the direction of winding must be reversed. For this purpose an embodiment of the invention provides that limit switches be placed at the limit positions of the relative siting of the drum and guide with respect to each other, for the purpose of reversal of rotational direction of the spooling drive.

Another possibility of limiting the total laying width and/or of effecting a reversal of direction consists, according to the invention, in providing a second programme counter device which, in the event of a multiplicity of emitted signals from the first programme counter device, switches the spooling drive over and/or off.

As already mentioned above, the guide can be arranged stationary whilst the drum can be moved in the direction of the axis. In order here also to utilise the device according to the invention, an embodiment of the invention finally provides that, a count wheel is fitted to the supporting frame of the drum; that this wheel runs along a track when the supporting frame is shifted, and that the second markers are attached to the count wheel, or to a component driven by it. Of course, it could be essentially conceivable to connect the second markers with the spooling drive which actuates the movement of the supporting frame in the direction of the axis of the drum. This procedure would, however, be unfavourable in so far as slip between the spooling drive and the supporting frame is not to be avoided, and thus incorrect laying distances would be counted.

BRIEF DESCRIPTION OF THE DRAWINGS

The invention will now be further described, by way of example, with reference to the accompanying drawings, in which.

DESCRIPTION OF THE PREFERRED EMBODIMENT

Figure 1:
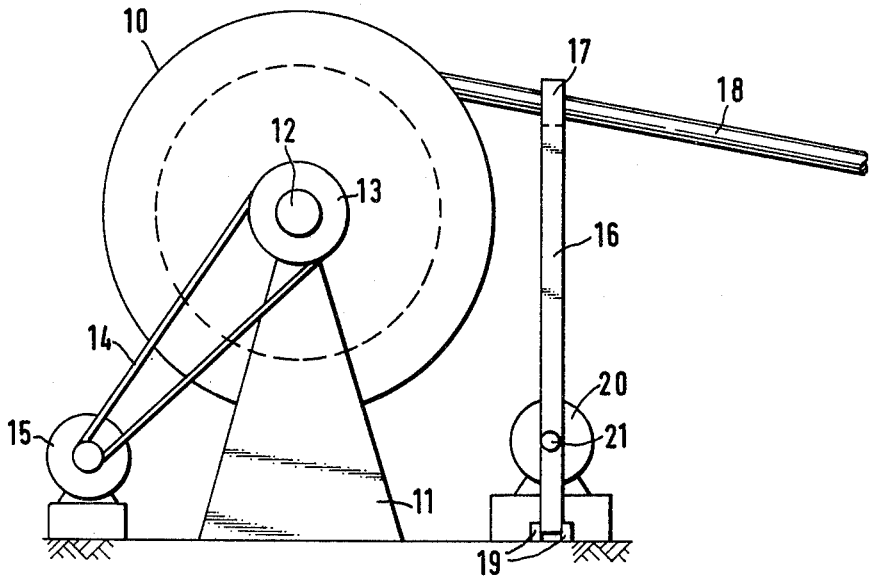
FIG. 1 shows schematically the side view of a winding installation.

A winding drum 10, capable of being rotated, is supported by a stand 11 whereby a shaft 12, which rests on the stand 11 is provided with a driving pulley 13 around which is a driving belt 14. A geared motor 15 drives the pulled 13 by means of the belt 14 and with it the drum 10. A laying fork 16 is situated in a laying-on direction before the drum 10; in the upper fork position 17 a cable 18 is directed with relation to the drum 10. The laying fork 16 is situated parallel to the axis of the drum 10 and is capable of being moved; in this it is guided by a guide 19. The moving of the laying fork 16 is brought about by means of a spooling motor 20 which drives a spooling spindle 21.

Figure 2:
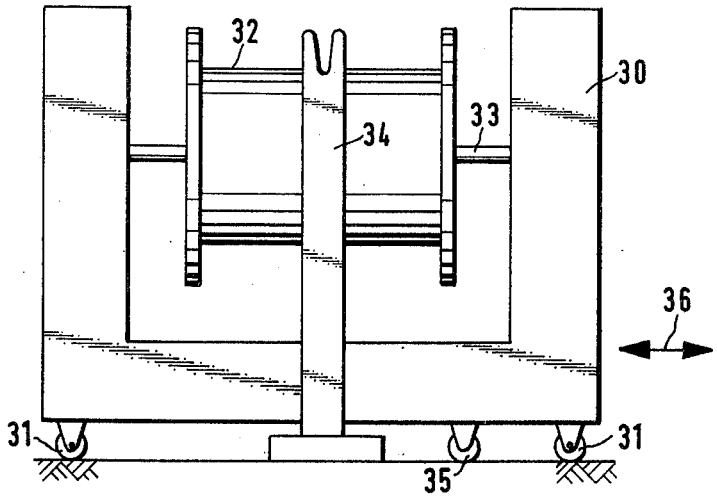
FIG. 2 shows schematically the front elevation of another winding installation.

In the winding installation according to FIG. 2 a supporting frame 30 is in the shape of a trolley with rollers 31 which run on rails or similar, whereby at least one roller 31 is capable of being driven by a spooling drive, which is not shown. A winding drum 32 is mounted on a shaft 33 which is driven by a winding motor which is contained in the supporting frame 30. A laying fork 34 is situated in front of the drum 32 in the direction of feed of the material to be wound.

On the under side of the frame 30 there are wheels of which one runs, as a metering wheel 35 along a track, and by means of which the progress made along the path, in the direction of the double arrow 36, by the supporting frame, is measured, as will be more closely described subsequently.

Figure 3:
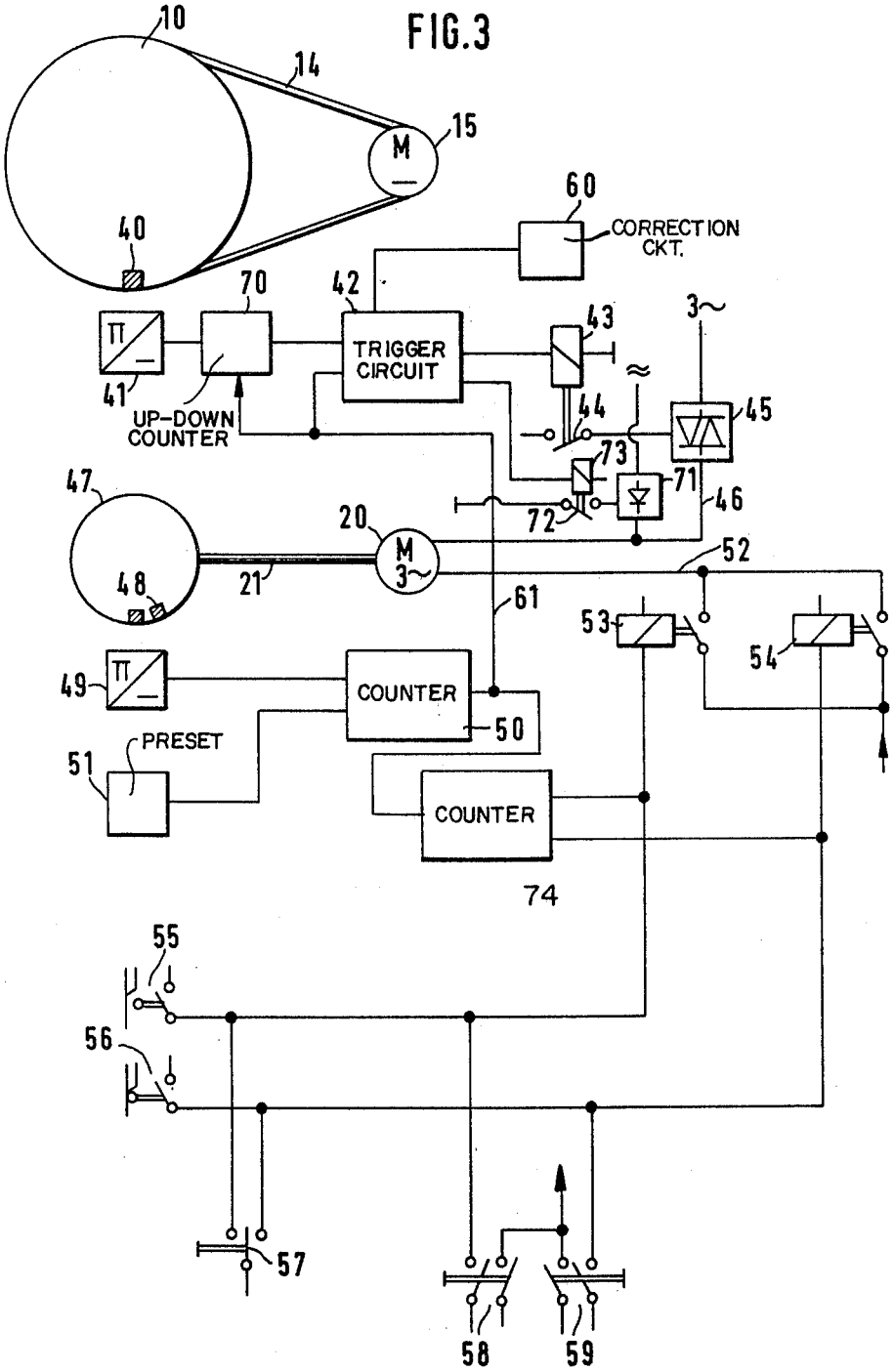
FIG. 3 shows a switch circuit and arrangement for the device in accordance with the invention.

In principle the switch circuit shown in FIG. 3 can be used for the winding installation as in FIG. 1 as also for the installation as in FIG. 2, or for a selected combination of both. However, in the following, FIG. 3 will only be described with respect to the winding installation as in FIG. 1. The same parts will thus be furnished with the same reference numbers.

For the winding motor 15 a D.C. motor is used to drive the drum 10. This has a metal lug 40 on its circumferance. A proximity switch 41 is provided on the drum 10; this proximity switch 41 is connected to a trigger action circuit 42 by way of a forwards-backwards counter 70. The output of the trigger action is connected to a relay 43 whose contact switch 44 switches a three phase triac relay which is situated in a lead 46 to the spooling motor 20, which in itself consists of a three phase motor with a squirrel cage rotor. The three phase motor 20 drives the spooling spindle on which there is a disc 47 which on its circumference exhibits several metal lugs 48, placed at equal distances. The disc 47 is provided with a proximity switch 49 whose output is switched to a programme counter device 50, whose other input is connected to a preselection counter 51. The output of the counter 50 is connected to a further input of the trigger action circuit 42 and the forwards-backwards counter 70.

Reversing relays 53, 54 are inserted in a further lead 52 to the three phase motor 20, which control the direction of rotation of the motor. In the control circuitry of relays 53 and 54 there are limit switches for the limiting positions of the laying fork 16 (FIG. 1). Also included in the control circuit are a directional pre-selector switch 57 and two switches 58 and 59 for inching service. A second counter 74 is connected to the output of counter 50. The output of counter 74 also operates relays 53 and 54.

A rectifying stage 71 is connected to the lead 46 to three phase motor 20. In this manner the motor 20 can be excited with direct current which leads to a braking of the squirrel cage rotor. The control action of the rectifying stage 71 takes place over a contact switch 72 of a relay 73, which is connected to a further output of the trigger action circuit 42.

Finally a correction element 60 is connected to the trigger action circuit 42.

The circuit arrangement as in FIG. 3 operates as follows:

With each revolution of the drum 10 the metal lug 40 generates an impulse in the proximity switch 41, which leads to the actuation of the relay 43, whose contact switch 44 controls the triac relay, so that this without contact puts the motor 20 under voltage, whereby this by means of suitable adjustment of the pre-selection switch 57 begins to turn in the predicted direction, in order to drive the spooling spindle 21, so that this, for its part, moves the laying fork 16 (FIG. 1). With the rotation of the spooling spindle 21 the disc 47 is turned, so that its contact lugs 48 release an impulse each time in the proximity switch 49, which is passed to the programme counting device 50. A preselected impulse number is set in the programme counting device with the aid of the pre-selection counter 51. As soon as the number of impulses delivered from the proximity switch is attained, the programme counting device 50 passes a signal over the lead 61 to the trigger element 42, so that this de-activates the relay 43 at the output and the triac relay switches off the motor 20. Simultaneously relay 73 is excited in order to excite the three phase motor with direct current over the contact switch 72 and the rectifying stage 71, for the purposes of braking. The direct current exitation must naturally be terminated as soon as the motor 20 has come to rest. The stopping of the motor 20 can, for example, be ascertained over the proximity switch 49, for the purpose of de-activation of the relay 73.

The counting device 50 is constructed in such a way that after attaining the theoretical impulse number it returns to zero, so that an overrunning of the motor 20 and with it the spindle 21 is measured by accounting of the impulses, so that at the next laying operation the disc 47 needs to generate a fewer number of impulses, so that once again the programmed theoretical number of impulses is arrived at. In this manner a compensation for the overrun of the spooling drive is achieved, irrespective of its extent.

By means of the switch circuit described a laying can be effected to within fractions of a millimetre. By means of the correction element 60, however, a correction of the laying can be carried out independent from the indicated arrangement. THus the switching in of the three phase motor 20 can be suppressed or maintained in spite of the attainment of the programmed number of impulses, according to the kind and direction of the desired correction.

Switches 58 and 59 make possible a so called inching service, which is necessary, for example, after the insertion of a new drum, so that the laying fork can be driven into the end and/or starting position. Moreover it is conceivable to provide a further counting device that extracts count signals from the number of reversals of the spooling motor and the number of plies, in order to switch the entire device off when the winding drum is fully wound.

It can happen very often that because of the overrun of the motor 20, the value set in the counting device is reached more than once, for example, three of four times or even more. For this purpose each impulse of the counting device 50 that corresponds to the number of count signals having reached the programmed value at the proximity switch 49, is passed to the forwards-backwards counting device 70, which only then lets a signal pass through, if there is still stored in the counting device 70 the impulse which corresponds to the first impulse of the counting device 50. If a number of more than 1 impulse is stored in the counting device 70, all must be first cancelled save one, before the spooling motor 20 is switched on again. With this it is made certain that the laying fork does not traverse too far because of the overrun of motor 20. Without the counting device 70 the switching would not pick up an overrun which exceeded the value stored in counting device 50.

What is claimed is:

1. Apparatus for controlling for the laying of strip material on a rotating drum having a laying guide, the guide and drum being relatively moveable with respect to each other in a direction parallel to the axis of the drum, the movable one of the guide or drum having a movement continuing inertia, said apparatus comprising:

rotary alternating current induction motor drive means operatively associated with one of said drum and guide for providing movement between the two;

first indicator means for indicating the rotation of the drum;

control means connected to said drive means, said control means being coupled to, and operable by, said first indicator means for energizing said drive means to provide the relative movement responsive to rotation of the drum;

second indicator means for indicating relative movement of the drum and guide and for providing a digital feedback signal proportional to the amount of such movement;

preset means providing a digital reference signal corresponding to a desired incremental amount of such movement; and digital signal counter means coupled to said preset means for receiving and storing said digital reference signal, said digital signal counter means being coupled to said second indicator means for receiving and ascertaining the magnitude of said feedback signal, said digital counter comparing said reference and feedback signals and being coupled to said control means for deenergizing said drive means when the magnitude of said feedback signal attains that of the reference signal, said digital signal counter means storing digital feedback signals resulting from the inertial movement of the movable one of the drum and guide for altering a subsequent comparison of the reference and feedback signals in accordance with the stored signals.

2. The apparatus as claimed in claim 1 wherein said digital signal counter means is further defined as resettable when the magnitude of the digital feedback signal attains that of the digital reference signal, and as storing digital signals resulting from inertial movement after resetting for altering a subsequent comparison of the reference and feedback signals in accordance with the stored signals.

3. The apparatus as claimed in claim 1 including override means coupled to said drive means for operating the drive means independently of said first indicator means.

4. The apparatus as claimed in claim 1 including means for ascertaining when the relative position of the drum and guide exceeds a desired relative position and for blocking energization of the drive means when the relative position of said drum and guide is in excess of said desired relative position.

5. The apparatus as claimed in claim 4 wherein said position ascertaining means comprises and up-down counter connected to said digital signal counter means for counting in one direction responsive to the comparison of the reference and feedback signals by said digital signal counter means and connected to said first indicator means for counting in the other direction responsive to rotation of the drum.

6. The apparatus as claimed in claim 1 wherein said control means includes a semi-conductor switch.

7. The apparatus as claimed in claim 1 further including limit switches operatively associated with the moveable one of the drum and guide and coupled to said control means for altering the operation of the drive means when the moveable element of the drum or guide attains a limit position.

8. The apparatus as claimed in claim 1 further including a second counter coupled to the output of said digital signal counter means and having an output coupled to said control means for altering the operation of the control means and the energization of the drive means upon a predetermined number of comparison operations of the comparison means counter.

9. The apparatus as defined in claim 1 further defined as suitable for use in an arrangement wherein the laying guide is the moveable element.

10. The apparatus as claimed in claim 1 further defined as suitable for use in an arrangement in which the drum is the moveable element.

11. The apparatus as claimed in claim 1 wherein said control means includes means for braking the drive means upon the de-energization of the drive means.

12. The apparatus as claimed in claim 11 wherein said braking means comprises means for providing D.C. excitation to said induction motor drive during braking.

* * * * *